US006725748B1

(12) United States Patent
Tseng

(10) Patent No.: US 6,725,748 B1
(45) Date of Patent: Apr. 27, 2004

(54) COLLAPSIBLE PLIERS

(75) Inventor: Yi Chuan Tseng, Taichung Hsien (TW)

(73) Assignee: Awi Acquisition Company, Sylmar, CA (US)

( * ) Notice: Subject to any disclaimer, the term of this patent is extended or adjusted under 35 U.S.C. 154(b) by 0 days.

(21) Appl. No.: 10/285,167

(22) Filed: Oct. 30, 2002

(51) Int. Cl.[7] ..... B25B 7/02
(52) U.S. Cl. ..... 81/418; 81/416; 7/128; 7/168
(58) Field of Search ..... 81/418, 467, 416; 7/138, 165, 168, 170, 128; 30/260

(56) References Cited

U.S. PATENT DOCUMENTS 5,142,721 A * 9/1992 Sessions et al. ..... 7/128
6,023,805 A * 2/2000 Lin ..... 7/128
6,219,870 B1 * 4/2001 Swinden et al. ..... 7/128
6,223,374 B1 * 5/2001 Lin ..... 7/127
6,226,822 B1 * 5/2001 Chen ..... 7/128
6,601,254 B1 * 8/2003 Walz ..... 7/128
6,647,835 B1 * 11/2003 Tseng ..... 81/423

* cited by examiner

*Primary Examiner*—Lee D. Wilson
(74) *Attorney, Agent, or Firm*—Jack C. Munro

(57) ABSTRACT

A collapsible pliers where a jaw assembly is mounted between a pair of handles. The jaw assembly is movable relative to the handles from a retracted position to an extended position which will permit the jaw assembly to move to an open position and the jaw assembly used in a conventional manner by squeezing of the handles to move the jaw assembly from the open position to a gripping position.

14 Claims, 3 Drawing Sheets

COLLAPSIBLE PLIERS

BACKGROUND OF THE INVENTION

1. Field of the Invention

The field of this invention relates to hand tools and more particularly to a pair of pliers where the jaws of the pair of pliers can be collapsed into the handle assembly and then movable to protrude from the handle assembly during usage of the pliers.

2. Description of the Related Art

A hand tool in the form of a pair of pliers has long been known. A conventional form of a pair of pliers comprises a pair of handles mounted in a scissors arrangement. One end of the handles is adapted to connect with the user's hand. The opposite end of the handles includes an operating head. The operating head includes a pair of jaws. Squeezing together of the handles causes the jaws to be moved toward a closed position which will place the jaws in a gripping position. An object that is to be gripped is to be located between the jaws, and when the jaws are moved to the gripping position, the object is gripped.

A typical pair of pliers ranges generally from six inches to twelve inches in length. Tradesmen commonly have clothing that is designed to facilitate the carrying of a pair of pliers, such as having a small pocket that facilitates the storing of the pliers when such are carried from one job location to another. However, most non-trade type of people do not wear clothing that is designed to facilitate carrying of pliers. If such a person wishes to carry a pair of pliers, they must be carried in one's pocket or purse. The carrying of a pair of pliers in one's pocket or purse inherently constitutes a cumbersome item that takes up a substantial amount of space.

The having of a pair of pliers available to an individual can, at times, be a desirable practice. If a pair of pliers could be constructed that when such are not being used that the pliers occupies a small amount of space, such would be a desirable feature as then the pliers could then be readily carried in one's pocket or purse.

SUMMARY OF THE INVENTION

A first embodiment of collapsible pliers which takes the form of a jaw assembly formed of a first pair of jaws which are pivotally mounted together so the jaws can move between an open position and a gripping position and a closed position where the pair of jaws abut each other. The jaw assembly includes track means. A housing that is composed of separate spaced apart handles is connected with the jaw assembly. The handles are both movable on the track means between a first extended position and a retracted position. The first extended position locates the handles in juxtaposition with the first pair of jaws protruding from the handles permitting the first pair of jaws to move to the open position and then to a gripping position by applying of a manual squeezing force to the handles. The retracted position is when the first pair of jaws is located between the handles.

A further embodiment of the present invention is where the first basic embodiment is modified by the jaw assembly including a spring which exerts a continuous bias tending to locate the first pair of jaws in the open position.

A further embodiment of the present invention is where the first basic embodiment is modified by the track means being defined as a groove assembly.

A further embodiment of the present invention is where the first basic embodiment is modified by each handle having a channel with a jaw of the jaw assembly being mounted within each channel.

A further embodiment of the present invention is where the first basic embodiment is modified by the jaw assembly including a second pair of jaws located opposite the first pair of jaws and facing in a direction opposite the first pair of jaws.

A further embodiment of the present invention is where the just previous embodiment is modified by the second pair of jaws being movable to a second extended position which is located opposite the first extended position and located at the opposite end of the housing.

A further embodiment of the present invention is where a second basic embodiment of this invention comprises a handle assembly with a jaw assembly being mounted thereto. The jaw assembly is movable from a retractable position from the handle assembly to an extended position protruding from the handle assembly which will automatically locate the jaw assembly in an open position. Manual squeezing of the handle assembly will cause the jaw assembly to move from the open position to a gripping position.

A further embodiment of the present invention is where the second basic embodiment is modified by the jaw assembly including a spring which continuously biases the jaw assembly toward the open position.

A further embodiment of the present invention is where the second basic embodiment is modified by the jaw assembly including a first pair of jaws and a second pair of jaws with the second pair of jaws being located opposite the first pair of jaws and facing in a direction opposite the first pair of jaws.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
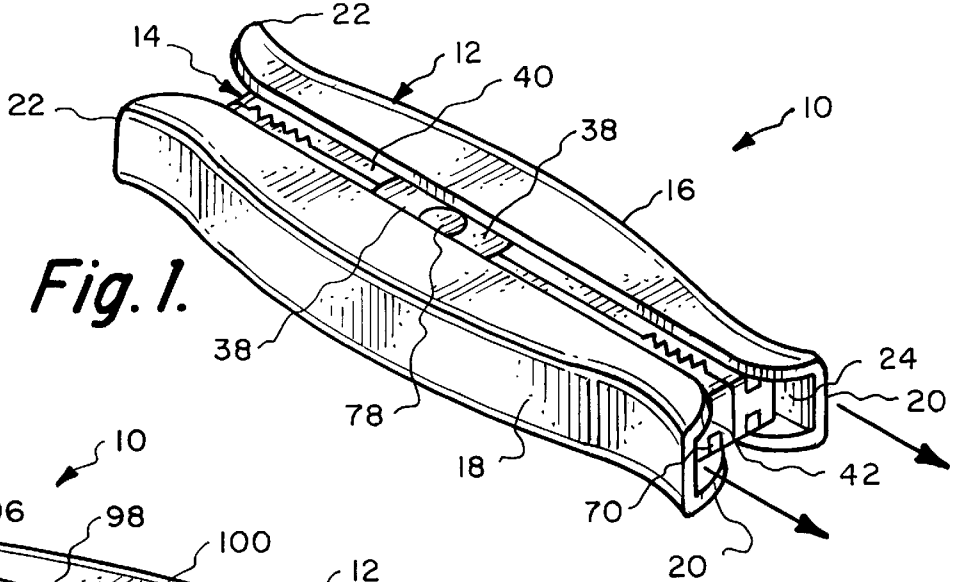
FIG. 1 is an isometric view of the collapsible pliers of the present invention showing the pliers in the collapsed configuration.

Referring particularly to the drawings, there is shown the collapsible pliers 10 of this invention which is composed generally of a housing 12 and a jaw assembly 14. The housing 12 is composed of a pair of separate handles 16 and 18. The handles 16 and 18 are constructed to be identical and each has flared ends 20 and 22. In transverse cross-section, each handles 16 and 18 is basically U-shaped defining an internal channel 24. Each of the channels 24 is open ended. Access into the channel 24 can be accomplished at each of the flared ends 20 and 22 or can be through the open side which defines rectangular opening 26 which is located between a first pair of facing rails 28 and 30 and a second pair of facing rails 32 and 34. The rails 32 and 34 are located directly adjacent the flared ends 22 with the rails 28 and 30 being located directly adjacent the flared end 20.

The jaw assembly 14 is composed of a jaw element 34 and a jaw element 36. Jaw element 34 has a circular center section 38 from which is integrally connected and extends a jaw 40 and a jaw 42. The jaw 42 extends basically one-hundred eighty degrees opposite to jaw 40. The center section 38 includes a center hole 44. The jaw 40 includes a planar inner surface 46 which includes a series of serrations 48. In a similar manner, the jaw 42 includes a planar inner surface 50 which also includes a series of serrations 52.

Longitudinally formed on the jaw 40 is upper and lower longitudinal grooves 54 and 56. The grooves 54 and 56 are located parallel to each other and extend from the outer end of the jaw 40 to the center section 38. Formed within the center section 38 is a groove 58. Groove 58 is the same configuration in dimension in transverse cross-section as groove 54 and is in continuous alignment with groove 54. Groove 58 is also of the same configuration and of the same size in transverse cross-section as groove 56 and is also in continuous alignment with groove 56. However, it is to be understood that groove 58 could be a slightly different configuration than groove 54 if such was desired. One end of groove 58 connects with groove 54 with the opposite end of groove 58 being open ended. At the outer end of groove 54 there is located a protuberance 62. A similar protuberance 64 is mounted within the groove 56. These protuberances 62 and 64 are only slightly raised off the bottom surface of each of their respective grooves 54 and 56. With the rails 28 and 32 being slidably mounted within the grooves 54 and 58, the height of each of the rails 28 and 32 is selected so as to ride over the protuberance 62. The same is true also for the rails 30 and 34 relative to the protuberance 64.

The jaw 42 has a longitudinal groove 66 formed on its upper surface and is open at the outer end of the jaw 42 where there is located a protuberance 68. On the bottom side of the jaw 42 is a longitudinal groove 70 which has a protuberance 72 formed therein. The groove 70 is parallel to the groove 66. Groove 66 is in alignment with a groove 74 that is formed within the center section 38. Groove 70 will also be in alignment with a groove, which is not shown, which is formed within a center section 76. It is also to be understood that the groove 56 will be in alignment with a groove formed on the undersurface of the center section 76, which is not shown. It is to be noted that grooves 66 and 54 are located parallel to each other as is also grooves 58 and 74 are parallel.

The center section 76 includes an upstanding pin 78. The pin 78 is pivotally mounted within center hole 44. Surrounding the pin 78 and formed within the center section 76 is an annular groove 80. Mounted within the groove 80 is a spring 82. Spring 82 includes right angled ends 84 and 86. End 84 is mounted within a hole, which is not shown, formed within the groove 80. End 86 is mounted within a hole 88 formed within the center section 38. The spring 82 will exert a continuous bias tending to locate the jaw assembly 14 in an open position, which is shown in FIGS. 2 and 4 of the drawings.

Integrally mounted to the center section 76 is a jaw 90 and a jaw 92. Jaw 92 extends basically one-hundred eighty degrees opposite the jaw 90. Jaw 90 includes a planar inner face 94 which has formed therein a plurality of serrations 96. In a similar manner, the jaw 92 has a planar face 98 which has formed therein a plurality of serrations 100. The upper surface of the jaw 90 has a longitudinal open ended groove 102 which includes at its outer end a protuberance 104. In a similar manner, the upper surface of the jaw 92 includes a longitudinal open ended groove 106 which has at its outer end a protuberance 108. On the bottom surface of the jaw 90 is a longitudinal open ended groove 110 which has formed therein at its outer end a protuberance 112. In a similar manner, there is a longitudinal open ended groove 114 formed in the bottom surface of the jaw 92. A protuberance 116 is formed within the outer open end of the groove 114. The bottom surface of the center section 76 will include a pair of grooves (not shown) similar to grooves 58 and 74 and also parallel to each other and parallel to grooves 58 and 74. One of these grooves aligns with groove 114 and the other with groove 110.

Figure 2:
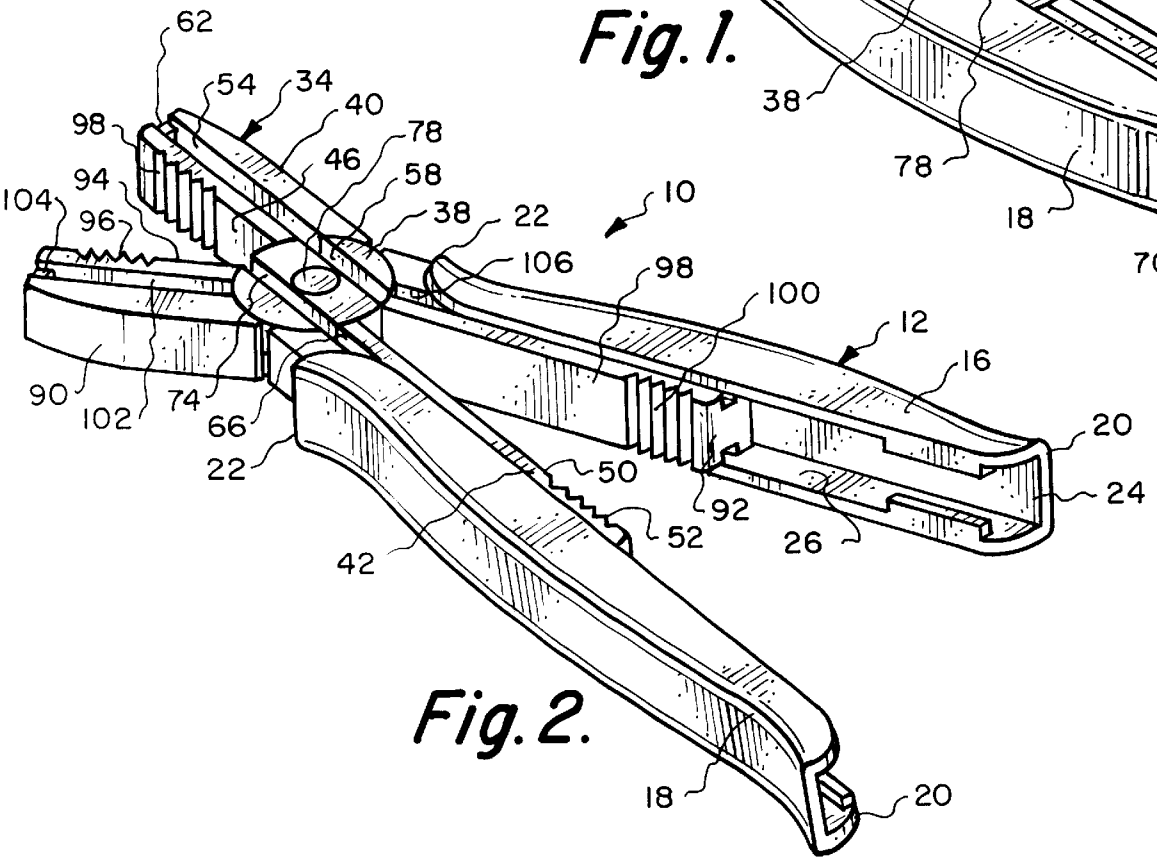
FIG. 2 is an isometric view of the collapsible pliers of the present invention showing a first set of jaws protruding that can be moved to a gripping position by squeezing of the handle assembly which forms the housing.
Figure 3:
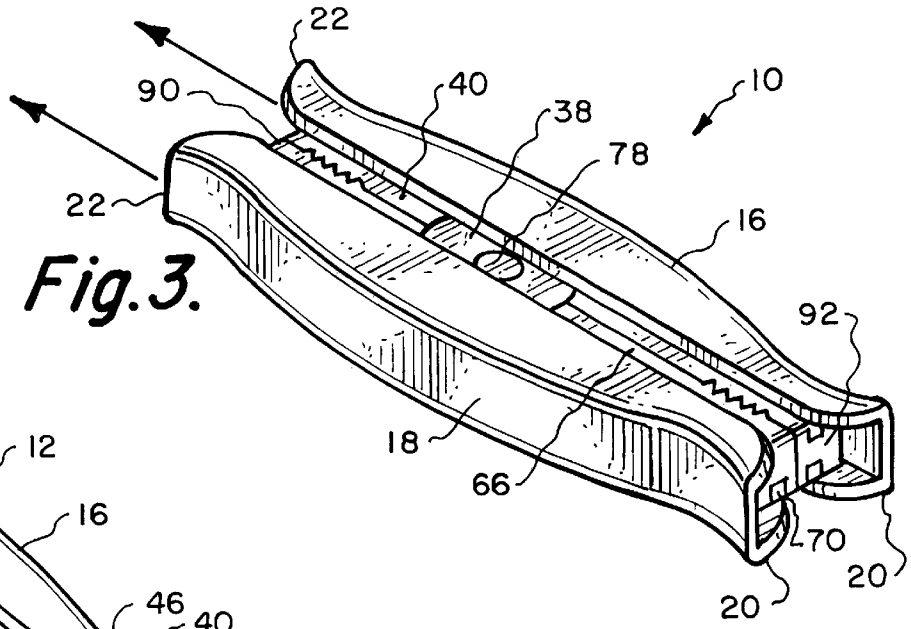
FIG. 3 is a view similar to FIG. 1 indicating how the handle assembly can be moved in order to cause a second pair of jaws to extend for usage.
Figure 4:
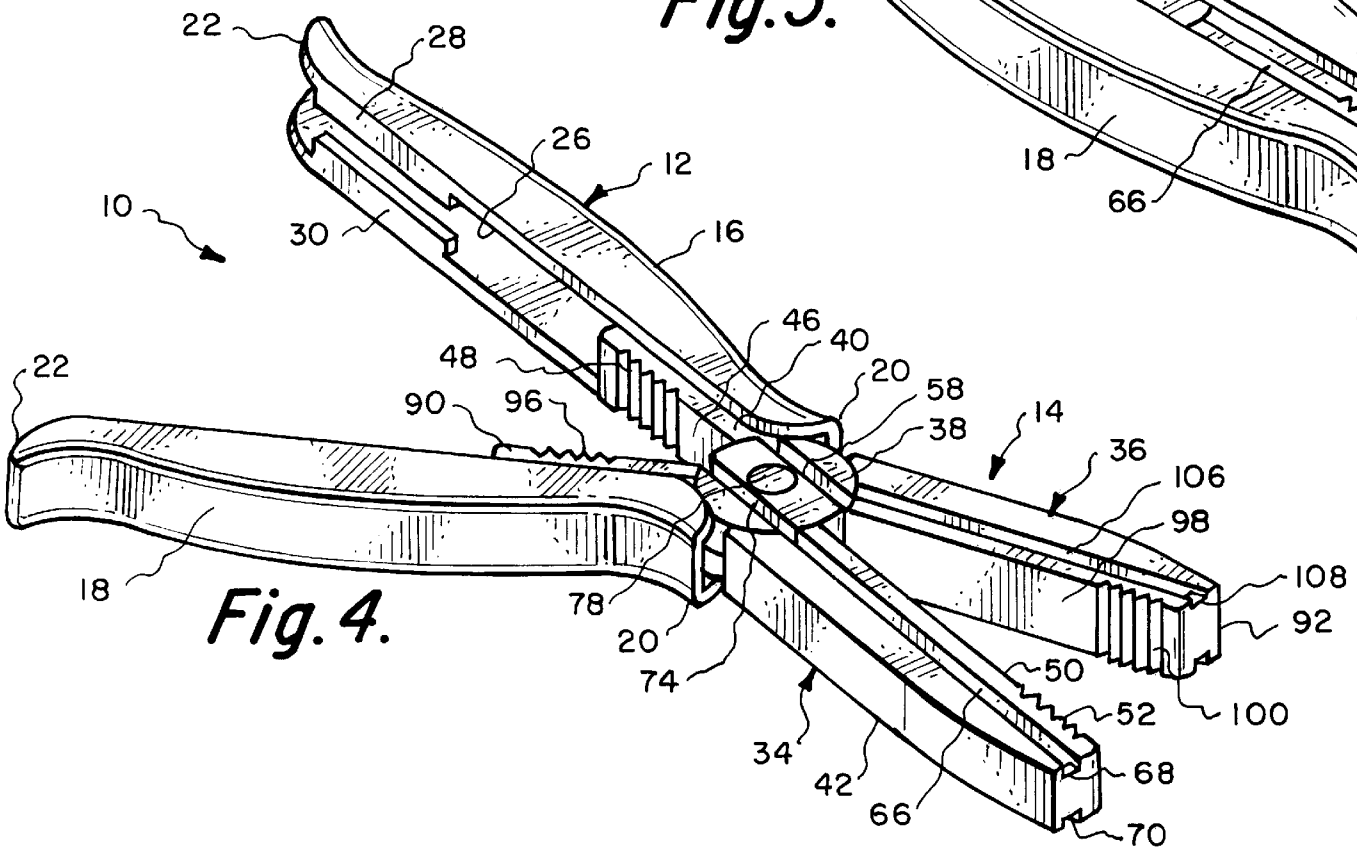
FIG. 4 is an isometric view of the collapsible pliers of the present invention showing the second pair of jaws being extended so as to be capable of being used.
Figure 5:
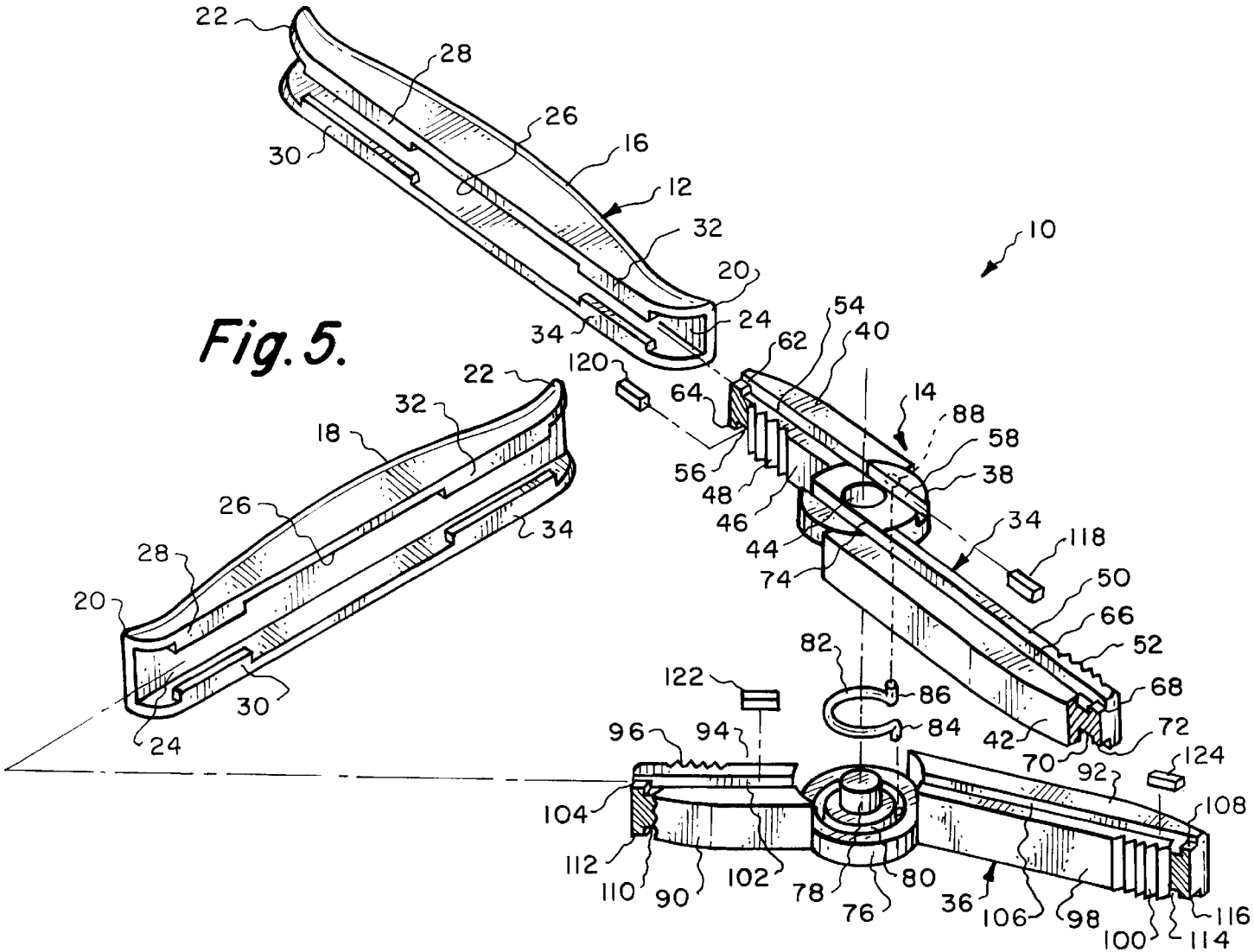
FIG. 5 is an exploded isometric view of the collapsible pliers of the present invention.

The jaw element 36 is pivotable between the open position, shown in FIGS. 2 and 4, to the closed position, shown in FIGS. 1 and 3 relative to the jaw element 34. When in the closed position, the grooves 106 and 54 are in alignment as well as grooves 66 and 102. With the rails 28 and 32 mounted within the grooves 54 and 106 and jaws 40 and 92 mounted within the interior channel 24, the handle 16 can be slid from the retracted position, shown in FIGS. 1 and 3 to an extended position, shown in FIGS. 2 and 4. It is also to be understood that the rails 30 and 34 will be located within the aligned grooves 56 and 114.

The rails 28 and 32 of the handle 18 will be slidably engaged with aligned grooves 102 and 66 with the rails 30 and 34 being engaged with aligned grooves 110 and 70. The result is the handles 16 and 18 can be manually moved relative to the jaw assembly 14 so as to cause the jaws 40 and 90 to be extended, as shown in FIG. 2, or jaws 42 and 92 extended, as shown in FIG. 4. It is to be understood that the different pairs of jaws will have different configurations, such as one maybe possibly blunt nosed and another one a needle nose configuration.

In order to prevent disengagement of handle 16 relative to either jaw 40 or jaw 92, there is included within groove 54, 58 and 106 a floating member 118. This floating member 118 will abut against rail 32 when the pliers is in the configuration shown in FIG. 4 and then will slide over and abut against rail 28 when the pliers is in the configuration of FIG. 2. This floating member 118 will abut against protuberance 62 when in the position of FIG. 4 and will abut against protuberance 108 when in the position of FIG. 2. Thusly, the floating rail functions as a device to limit the amount of movement of the jaw assembly 14 relative to the housing 12.

It is to be understood that there will be a similar floating member 120 that connects between the alignable grooves 56 and 114. There is also a similar floating member 122 that rides within the alignable grooves 102, 74 and 106. Additionally, there is a similar floating member 124 that rides within the alignable grooves 114 and 56. Each of the floating members 118, 120, 122 and 124 are to be engaged between their respective protuberances and rails to define the limit of the position of the handles 16 and 18 relative to the jaw assembly 14 to establish the pliers 10 of this invention in the position of FIG. 2 or in the position of FIG. 4.

What is claimed is:

1. A collapsible pliers comprising:

a jaw assembly formed of a first pair of jaws pivotally mounted together so said jaws can move between an open position and a gripping position and a closed position where said pair of jaws abut each other, said jaw assembly including track means; and a housing composed of a pair of separate spaced apart handles, both said handles connecting with said jaw assembly, both said handles being movable on said track means between a first extended position and a retracted position, said first extended position locates said handles in juxtaposition with said first pair of jaws protruding from said handles permitting said first pair of jaws to move to said open position and then to said gripping position by applying a manual squeezing force to said handles, said retracted position being when said first pair of jaws is located between said handles and with said first pair of jaws in said closed position not protruding exteriorly of said handles.

2. The collapsible pliers as defined in claim 1 wherein:

said first pair of jaws being continuously biased by a spring assembly toward said open position.

3. The collapsible pliers as defined in claim 1 wherein:

said track means comprising a groove assembly formed within said jaw assembly.

4. The collapsible pliers as defined in claim 1 wherein:

each of said handles having a channel with a jaw of said first pair of jaws being mounted within a said channel.

5. The collapsible pliers as defined in claim 1 wherein:

said jaw assembly including a second pair of jaws located opposite said first pair of jaws and facing in a direction opposite said first pair of jaws, said second pair of jaws also being capable of protruding from said housing which will permit said second pair of jaws to move to an open position and then to a gripping position by applying a manual squeezing force to said handles.

6. The jaw assembly as defined in claim 5 wherein:

said second pair of jaws being movable from said retracted position to a second extended position, said second extended position being located at an end opposite of said housing from said first extended position.

7. A collapsible pliers comprising:

a handle assembly; and a jaw assembly mounted to said handle assembly, said jaw assembly being movable from a retracted position from said handle assembly to an extended position protruding from said handle assembly which will automatically locate said jaw assembly in an open position, manual squeezing of said handle assembly will cause said jaw assembly to move from said open position to a gripping position.

8. The collapsible pliers as defined in claim 6 wherein:

said jaw assembly being continuously spring biased toward said open position.

9. The collapsible pliers as defined in claim 6 wherein:

said jaw assembly including a first pair of jaws and a second pair of jaws with said second pair of jaws being located opposite said first pair of jaws and facing in a direction opposite said first pair of jaws.

10. A method of constructing a pair of pliers comprising the steps of:

utilizing a pair of handles located in juxtaposition but spaced apart; and mounting of a jaw assembly within each handle where said jaw assembly can be moved from a retracted position located between said handles to an extended position protruding from said handles and when in said extended position said handles assume an angular disposition as well as said jaws where said jaws can move toward each other to a grasping position by manually squeezing of said handles together.

11. The method as defined in claim 10 wherein the utilizing step includes selecting identical handles and mounting of same in a reversely facing relationship.

12. The method as defined in claim 10 wherein the mounting step includes connecting of said jaw assembly together in a pivotally mounted scissors arrangement.

13. The method as defined in claim 10 wherein the moving of said jaw assembly is accomplished by sliding of such relative to said handles.

14. The method as defined in claim 10 wherein the mounting step further comprises:

including a movement limiting means in conjunction with said jaws to limit the extent of movement of said jaws relative to said handles.

* * * * *